United States Patent [19]

Grembowicz et al.

[11] Patent Number: 4,905,120

[45] Date of Patent: Feb. 27, 1990

[54] DRIVER CIRCUIT FOR SOLENOID OPERATED FUEL INJECTORS

[75] Inventors: Conrad G. Grembowicz, Peoria; Brad Harrell, Morton, both of Ill.

[73] Assignee: Caterpillar Inc., Peoria, Ill.

[21] Appl. No.: 260,241

[22] Filed: Oct. 20, 1988

[51] Int. Cl.[4] ..... H01H 47/32

[52] U.S. Cl. ..... 36/154; 123/490; 361/167; 361/187; 323/272

[58] Field of Search ..... 361/152–156, 361/166, 167, 187, 168.1; 123/490; 323/271, 272

[56] References Cited

U.S. PATENT DOCUMENTS

| | | | |
|---|---|---|---|
| 4,327,693 | 5/1982 | Busser | 123/490 |
| 4,347,544 | 8/1982 | Ohba | 123/49 C |
| 4,550,659 | 11/1985 | Yamanga | 361/167 |
| 4,604,675 | 8/1986 | Pflederer | 361/155 |
| 4,631,628 | 12/1986 | Kissel | 123/490 |
| 4,680,667 | 7/1987 | Petrie | 123/490 |
| 4,764,840 | 8/1988 | Petrie et al. | 123/490 |

*Primary Examiner*—A. D. Pellinen

*Attorney, Agent, or Firm*—Marshall, O'Toole, Gerstein, Murry & Bicknell

[57] ABSTRACT

A driver circuit for first and second coils includes first and second selector switches coupled in series between first terminals of the coils and a first common junction, first and second diodes coupled in series between second terminals of the first and second coils, respectively, and a second common junction and a source of first potential coupled to the first common junction. A modulation switch is coupled between the second common junction and a source of second potential. The selector switches and modulation switches are operated to cause currents of controlled magnitude to flow through the coils. The circuit has improved fault immunity whereby at least one coil can be energized even when another coil has been subjected to a chassis ground fault.

8 Claims, 4 Drawing Sheets

DRIVER CIRCUIT FOR SOLENOID OPERATED FUEL INJECTORSTECHNICAL FIELD

The present invention relates generally to fuel controls for internal combustion engines, and more particularly to a driver circuit for operating fuel injectors.

BACKGROUND ART

Compression type internal combustion engines require the use of fuel injectors which deliver fuel under pressure to one or more cylinders. Such fuel injectors may be of the solenoid operated type which are operated by an engine control to deliver accurately measured quantities of fuel to the cylinders at precise instants in time based upon the positions of the pistons in the cylinders. The timing of fuel injection and the quantity of fuel injected during each injection operation affect the efficiency of the engine and the emissions therefrom. Thus, it is important to precisely control the timing and quantity of fuel delivered to the cylinders by means of a solenoid driver circuit which accurately controls the fuel injectors.

A prior solenoid driver circuit which is capable of precise timing and fuel quantity control is disclosed in Pflederer U.S. Pat. No. 4,604,675, entitled "Fuel Injection Solenoid Driver Circuit", assigned to the assignee of the present application and the disclosure of which is hereby incorporated by reference. FIG. 1 is a greatly simplified drawing of the Pflederer driver circuit wherein certain elements are identified by the same reference numerals as used in such patent. Each of a series of six fuel injector solenoid coils 168*a*–168*f* is coupled through a modulation switch 164 to a voltage source 10. Cylinder select switches 184*a*–184*f* are coupled between the solenoid coils 168*a*–168*f* and a series combination of an inductor 186 and a current sensing resistor 188. Flyback diodes 260*a*–260*f* include anode terminals which are coupled to the junctions between the coils 168*a*–168*f* and the switches 184*a*–184*f*. Cathode terminals of the diodes 260*a*–260*f* are coupled together to the voltage source 10. During operation of this circuit, an engine control 12 develops command signals which are coupled to cylinder select and current sense/control circuits that in turn operate the switches 184*a*–184*f* and a modulation switch 164. When a particular solenoid coil is to be actuated, for example the solenoid coil 168*a*, the switch 184*a* is closed by the cylinder select circuit 14. In addition, the current sense/control circuit 16 operates the switch 164 in a pulse width modulated (PWM) mode of operation to control the current delivered to the solenoid coil 168*a* according to a predetermined control strategy such that power dissipation is kept at a low level.

When the coil 168*a* has been energized for a sufficient time to insure that the proper quantity of fuel will be delivered to the associated engine cylinder, the switches 184*a* and 164 are opened, in turn causing flyback currents to flow from ground potential through the parallel combination of a resistor 252 and an inductor 254, a diode 256, the coil 168*a* and the diode 260*a* to the voltage source 10. This places a reverse potential across the coil 168*a* to quickly deenergize same.

While the driver circuit illustrated in the Pflederer patent is effective to control solenoid operated fuel injectors in an efficient manner, it has been found that the driver circuit can be totally disabled under certain circumstances, in turn leading to a complete shutdown of the engine. Specifically, if either terminal of any of the coils 168*a*–168*f* should be shorted to ground potential, there is no way to continue to energize the remaining coils in a controlled manner. Thus, under such a fault condition, there is no way to provide fuel to the cylinders and hence limp-home capability cannot be realized.

DISCLOSURE OF THE INVENTION

In accordance with the present invention, a driver circuit for energizing at least first and second coils permits one of the coils to be energized in a controlled manner even when the other coil has been shorted to ground.

More specifically, a driver circuit for first and second coils includes first and second selector switches coupled in series between first terminals of the first and second coils, respectively, and a first common junction. First and second diodes are coupled in series between second terminals of the first and second coils, respectively, and a second common junction. A source of first potential is coupled to the first common junction and a modulation switch is coupled between the second common junction and a source of second potential. Means are coupled to the selector switches for selectively closing the switches at desired points in time and means are provided for operating the modulation switch while at least one of the selector switches is closed such that currents of controlled magnitude flow through the coils.

In a preferred embodiment of the invention, the driver circuit is particularly adapted for use in controlling solenoid operated fuel injectors which control the flow of fuel into associated cylinders of an internal combustion engine. Significantly, shorting to ground of a terminal of one of the solenoid coils does not totally disable the engine, inasmuch as the diodes isolate the coils and prevent the flow of shorting currents to at least some of the remaining coils. Thus, at least a portion of the remaining coils can continue to be controlled to provide fuel to one or more of the engine cylinders. This provides a limp-home capability which is not realized by the prior art.

DESCRIPTION OF THE PREFERRED EMBODIMENT

Figure 1:
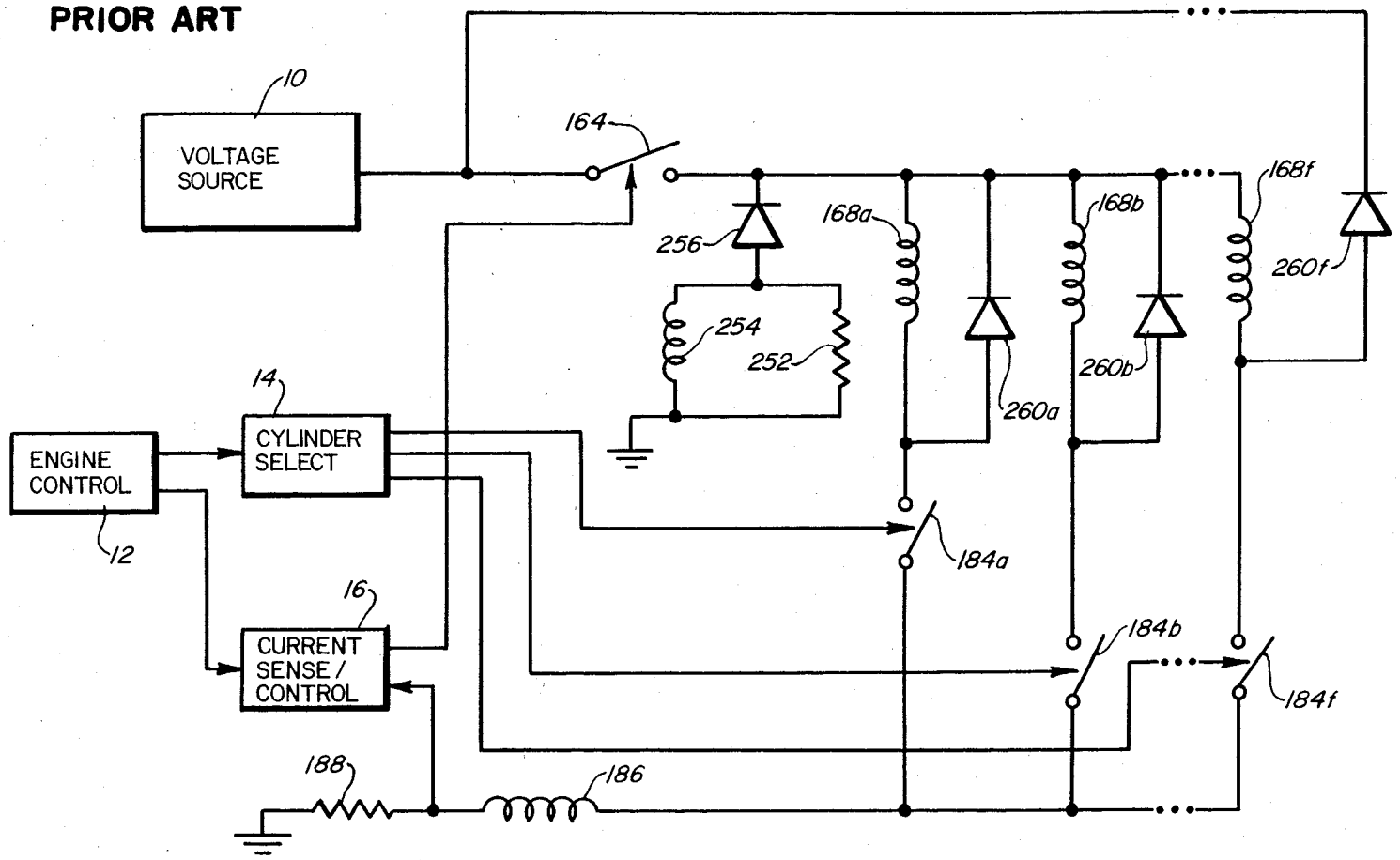
FIG. 1 PRIOR ART
FIG. 1 is a simplified combined schematic and block diagram of the prior art solenoid driver circuit disclosed in the above-identified Pflederer patent.
Figure 2:
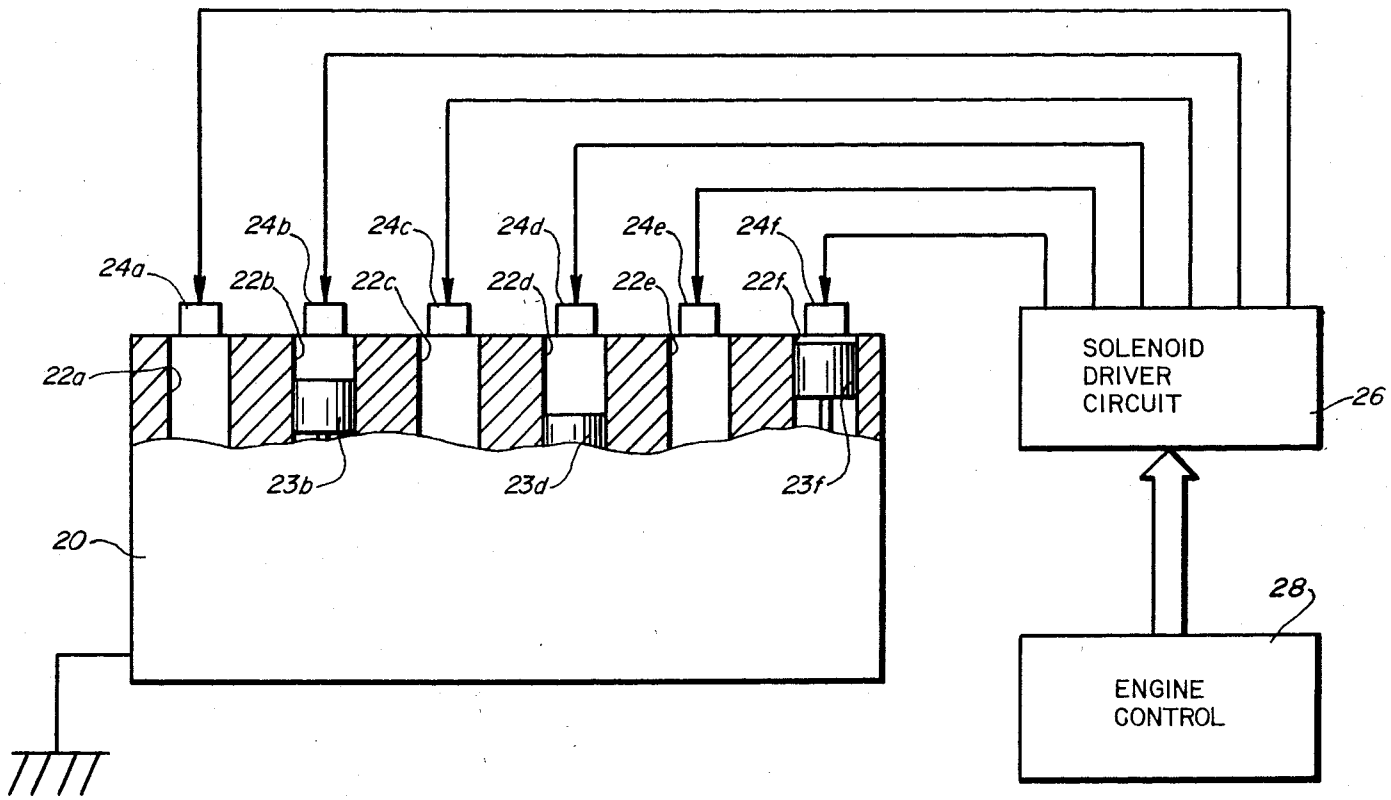
FIG. 2 is a combined diagrammatic and block diagram of an internal combustion engine together with associated control and driver circuit according to the present invention.

Referring now to FIG. 2, an internal combustion engine 20 of the compression or diesel type includes N cylinders 22 which are provided fuel by N solenoid operated fuel injectors 24. In the illustrated embodiment, N =6, and hence there are six cylinders 22*a*–22*f* and six fuel injectors 24*a*–24*f* associated therewith, respectively. The fuel injectors 24*a*–24*f* include solenoid coils, described in greater detail hereinafter in connection with FIG. 3, which are energized by a solenoid driver circuit 26 according to the present invention. The driver circuit 26 in turn receives signals developed by an engine control 28.

It should be noted that the engine control 28 forms no part of the present invention, and hence will not be described in greater detail herein.

Figure 3:
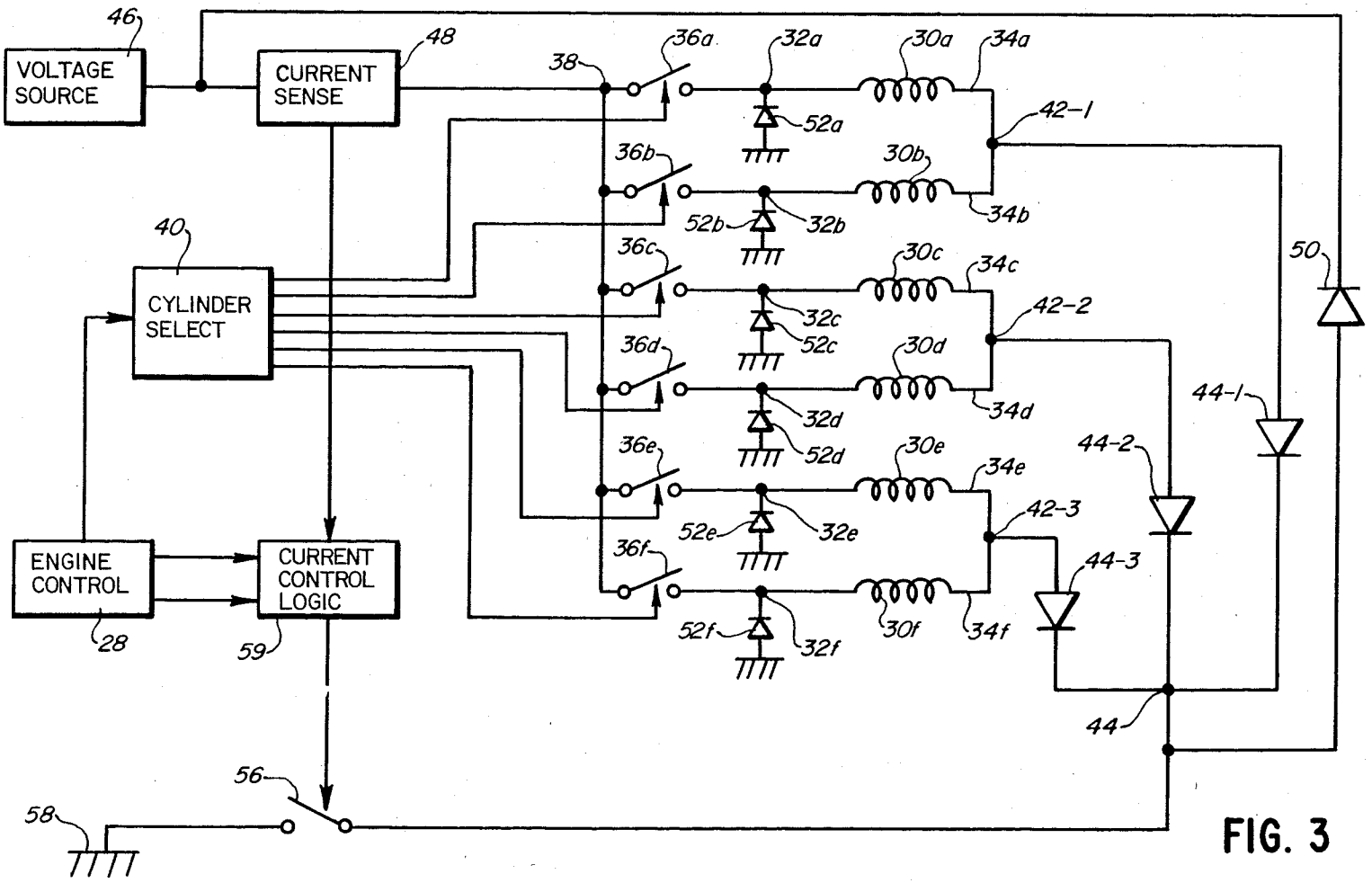
FIG. 3 is a simplified combined schematic and block diagram of the driver according to the present invention.

Illustrated in FIG. 3 is a simplified diagram of the driver circuit 26. Solenoid coils 30*a*–30*f* of the fuel injectors 24*a*–24*f*, respectively, include first terminals 32*a*–32*f* and second terminals 34*a*–34*f*. A plurality of N selector switches 36*a*–36*f* are coupled in series between the first terminals 32*a*–32*f* of the coils 30*a*–30*f*, respectively, and a first common junction 38. The selector switches 36*a*–36*f* may comprise, for example, bipolar transistors, although this need not be the case. The switches 36*a*–36*f* are controlled by a cylinder select circuit 40 which is in turn responsive to the command signals developed by the engine control 28.

Second terminals of pairs of associated coils 30*a*–30*f* are connected together to form N/2 coil junctions 42-1 through 42-3. More specifically, the second terminals 34*a* and 34*b* of associated coils 30*a* and 30*b* are connected together to form the coil junction 42-1. In like fashion, the second terminals 34*c*, 34*d* of associated coils 30*c*, 30*d* are connected together to form the coil junction 42-2 whereas the second terminals 34*e* and 34*f* of associated coils 30*e*, 30*f* are connected together to form the coil junction 42-3.

A plurality of N/2 isolation diodes 44-1 through 44-3 include anode terminals coupled to the coil junctions 42-1 through 42-3, respectively. Cathode terminals of the isolation diodes 44-1 through 44-3 are connected together at a second common junction 44.

A source of first potential in the form of a voltage source 46 is coupled via a current sensing circuit 48 to the first common junction 38. A turn off flyback diode 50 is coupled between the second common junction and the voltage source 46. As noted in greater detail hereinafter, the isolation diodes 44-1 through 44-3 and the diode 50, in conjunction with diodes 52*a*–52*f* coupled between the first terminals 32*a*–32*f* and chassis ground potential, respectively, provide a path for flyback currents to quickly deenergize the coils 30*a* –30*f*.

A modulation switch 56 is coupled between the second common junction and a source of second potential, illustrated by chassis ground symbol 58. The modulation switch 56 is operated by a current control logic circuit 59 which is in turn responsive to the current detected by the current sensor 48 and the signals developed by the engine control 28.

Figure 4:
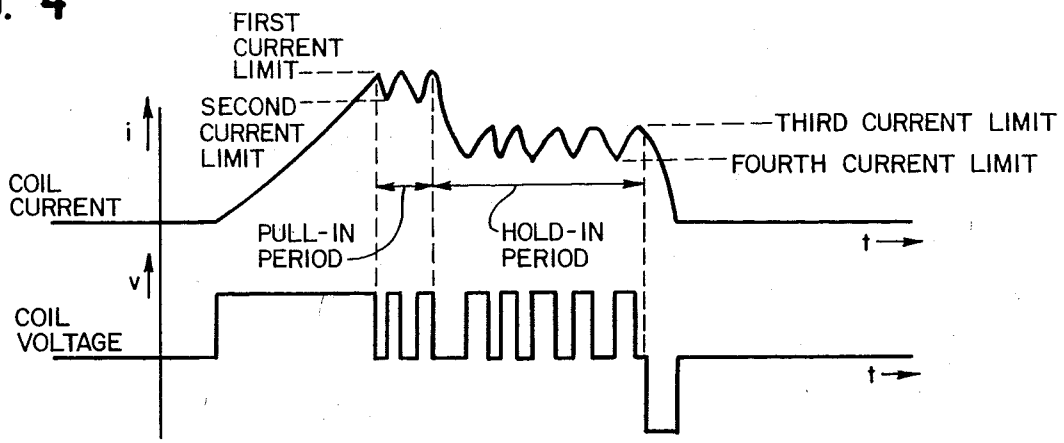
FIG. 4 is a pair of waveform diagrams illustrating the current and voltage delivered to the solenoid coils illustrated in FIG. 3.

In operation of the circuit shown in FIG. 3, the engine control 28 operates the cylinder select circuit 40 and the current control logic 59 to successively close different ones of the switches 36*a*–36*f* in synchronism with the position of pistons 23 (only three of which are 23*b*, 23*d* and 23*f* are shown in FIG. 2). Upon closure of each switch 36*a*–36*f*, the current control logic 59 operates the modulation switch 56 in accordance with the waveform illustrated in the bottom waveform diagram of FIG. 4. As seen in such waveform diagram, the switch 56 is operated in a PWM mode of operation wherein the duration of time the switch 56 is closed is dependent upon the current provided by the voltage source 46. During a first period of time during which the coil is energized to move an associated actuator (not shown) from a closed position to a fully opened position (hereinafter the "pull-in period"), the current delivered to the coil is controlled between first and second limits. More specifically, when the current from the voltage source reaches a first predetermined upper limit, as detected by the current sensor 48, the current control logic circuit 59 opens the switch 56, in turn causing an exponential decay of current supplied by the voltage source 46. When the current magnitude drops to a second predetermined lower limit, the switch 56 is again closed, causing the current supplied by the voltage source to rise.

At the end of the pull-in period, the current control logic 59 substitutes third and fourth current limits which are less than the first and second limits in effect during the pull-in period. Thus, the average current flowing through the coil during a subsequent period of time (hereinafter the "hold-in period") is less than the average current during the pull-in period.

At the end of the hold-in period, the selector switch 36*a*–36*f* which was closed is now opened, as is the switch 56. Inasmuch as the current through the associated coil 30*a* –30*f* cannot decay to zero instantaneously, current is drawn from chassis ground, through the associated diode 52*a*–52*f*, the coil 30*a* –30*f*, one of the diodes 44-1 through 44-3 and the diode 50 to the voltage source 46. This flyback current flow causes the potential across the respective coil 30*a* –30*f* to reverse polarity, in turn causing a rapid decay in the current flowing through the coil. This flyback operation causes the fuel injector to shut off rapidly, thereby permitting precise control over the quantity of fuel delivered to each engine cylinder.

Of particular significance in the circuit of FIG. 3, if a first terminal or a second terminal of a coil 30*a* –30*f* is shorted to chassis ground, only that coil and the coil connected to the same coil junction 42-1 through 42-3 will be adversely effected. This is due to the isolation provided by the diodes 44-1 through 44-3, which prevent current flow in a direction which would cause the short to propagate to the remaining coils. Thus, continued operation of the engine during such a fault is possible, albeit under reduced power so that the vehicle can be driven to a repair facility. This limp-home capability is a significant advantage realized by the present invention.

A further advantage of the present invention resides in the fact that the modulation switch 56 is connected between the coils 30 and chassis ground. If any of the coils should be shorted to ground, the current sensor 48 and the modulation switch 56 are not subjected to high current levels when supplying current to the non-shorted coils, and hence the switch 56 continues to modulate the currents through the non-shorted coils 30 in a controlled fashion. On the other hand, if the switch 56 were instead coupled between the voltage source 46 and the coils 30, a short to ground of a coil terminal could cause high magnitude currents to flow through the current sensor 48, even when attempting to supply current to the non-shorted coils, in turn causing the control logic 59 to open the switch 56 and thus prevent the delivery of controlled currents to such coils. It can be seen that connecting the switch 56 between the coils 30 and ground further enhances the limp-home capability noted above.

It should be noted that additional isolation may be provided to further limit the adverse effects of chassis ground shorts. This may be achieved by coupling each second terminal of each coil through an associated diode to the second common junction 44. Thus, a short to chassis ground at either terminal of a coil 30*a* -30*f* will be limited to such coil alone and the remaining coils will continue to operate in normal fashion. This further isolation is obtained through the use of N isolation diodes rather than N/2 isolation diodes, as is the case in the above-described embodiment, however.

It can be seen that the driver circuit of the present invention is simple in design and provides the desire protection against complete engine shut down in the event of a ground short.

We claim:

1. A driver circuit for first and second solenoid coils which control the actuation of first and second fuel injectors, respectively, wherein each fuel injector is operable to inject fuel into an associated cylinder of an engine and wherein a piston reciprocates within each cylinder, comprising:

first and second selector switches associated with the first and second solenoid coils, respectively, and coupled between first terminals of the first and second coils, respectively, and a first common junction;

first and second diodes coupled between second terminals of the first and second solenoid coils, respectively, and a second common junction;

a source of first potential coupled to the first common junction;

a source of second potential;

a modulation switch coupled between the second common junction and the source of second potential;

means coupled to the selector switches for selectively closing the switches at desired points in time in synchronism with the reciprocation of the pistons in the cylinder; and means for operating the modulation switch in alternating on and off states while each selector switch is closed whereby a first average magnitude of current is supplied to the associated solenoid coil during a first period of time and a second average magnitude of current is supplied to the associated solenoid coil during a second period of time subsequent to the first period of time so that a particular quantity of fuel is injected into each cylinder.

2. The driver circuit of claim 1, including third and fourth diodes coupled between the first terminals of the first and second coils, respectively, and the source of second potential, and a fifth diode coupled between the second common junction and the source of first potential wherein a forward potential is applied across each coil when the selector switch coupled in series with such coil is closed and wherein a reverse potential is applied across each coil due to current flow through one of the first and second diodes, one of the third and fourth diodes and the fifth diode immediately after the selector switch coupled in series with such coil is opened.

3. The driver circuit of claim 2, wherein the first potential is positive in polarity, the second potential comprises chassis ground and each of the first and second diodes are poled to conduct current from the second terminal of a coil to the second common junction whereby shorting of either terminal of a coil to chassis ground does not inhibit current flow through the other coil.

4. The driver circuit of claim 1, wherein the operating means comprises means for controlling each modulation switch in a pulse-width modulated mode of operation and wherein the first average magnitude of current is greater than the second average magnitude of current.

5. A driver circuit for N solenoid operated fuel injectors, each fuel injector being operated to control the flow of fuel into an associated cylinder of an internal combustion engine and each including a solenoid coil, comprising:

N selector switches each coupled in series between a first terminal of an associated one of the solenoid coils and a first common junction;

each of the solenoid coils having a second terminal wherein each solenoid coil is connected to another solenoid coil at second terminals thereof to form N/2 coil junctions; , N/2 diodes each coupled in series between a coil junction and a second common junction;

a source of first potential coupled to the first common junction;

a source of second potential;

a modulation switch coupled between the second common junction and the source of second potential;

means coupled to the N selector switches for selectively closing each selector switch at desired points in time; and means for operating the modulation switch while a selector switch is closed such that currents of controlled magnitude flow through the associated solenoid coil.

6. The driver circuit of claim 5, including N additional diodes each coupled between the first terminal of an associated solenoid coil and the source of second potential and a turn off flyback diode coupled between the second common junction and the source of first potential wherein a forward potential is applied across each coil when the selector switch coupled in series with such coil is closed and wherein a reverse potential is applied across each coil due to current flow through one of the N/2 diodes, one of the N additional diodes and the turn off flyback diode immediately after the selector switch associated with such coil is opened.

7. The driver circuit of claim 6, wherein the engine is mounted on a chassis and the first potential is positive in polarity, the second potential comprises chassis ground and each of the N/2 diodes are poled to conduct current from a coil junction to the second common junction whereby shorting of either terminal of a solenoid coil to chassis ground does not inhibit current flow through the remaining solenoid coils except the solenoid coil coupled to the same coil junction.

8. A driver circuit for first, second and third solenoid operated fuel injectors, each fuel injector being operated to control the flow of fuel into an associated cylinder of an internal combustion engine and each including a solenoid coil, comprising:

first, second and third selector switches each coupled between a first terminal of the first, second and third solenoid coils, respectively, and a first common junction;

each of the solenoid coils having a second terminal wherein the second terminals of the first and second solenoid coils are connected together at a coil junction;

a first diode coupled between the coil junction and a second common junction;

a second diode coupled between the second terminal of the third solenoid coil and the second common junction;

a source of first potential coupled to the first common junction;

a source of second potential;

a modulation switch coupled between the second common junction and the source of second potential;

means coupled to the three selector switches for selectively closing the switches at desired points in time; and means for operating the modulation switch in alternating on and off states while each selector switch is closed whereby a first average magnitude of current is supplied to the associated solenoid coil during a first period of time and a second average magnitude of current less than the first average magnitude of current is supplied to the associated solenoid coil during a second period of time subsequent to the first period of time so that a particular quantity of fuel is injected into each cylinder.

* * * * *